US008495810B2

(12) United States Patent
Masson et al.

(10) Patent No.: US 8,495,810 B2
(45) Date of Patent: Jul. 30, 2013

(54) PROCESS FOR MANUFACTURING A METAL PART REINFORCED WITH CERAMIC FIBRES

(75) Inventors: Richard Masson, Buc (FR); Dominique Ducos, Savigny sur Orge (FR)

(73) Assignee: Messier-Bugatti-Dowty, Velizy-Villacoublay (FR)

( * ) Notice: Subject to any disclaimer, the term of this patent is extended or adjusted under 35 U.S.C. 154(b) by 424 days.

(21) Appl. No.: 12/810,751

(22) PCT Filed: Dec. 24, 2008

(86) PCT No.: PCT/EP2008/068293

§ 371 (c)(1),
(2), (4) Date: Sep. 28, 2010

(87) PCT Pub. No.: WO2009/083572

PCT Pub. Date: Jul. 9, 2009

(65) Prior Publication Data

US 2011/0005060 A1 Jan. 13, 2011

(30) Foreign Application Priority Data

Dec. 28, 2007 (FR) ..... 07 09171

(51) Int. Cl.
*B23D 15/00* (2006.01)
*B23P 25/00* (2006.01)
*B23P 17/00* (2006.01)

(52) U.S. Cl.
USPC ..... 29/458; 29/419.1; 29/525.14; 29/527.1; 29/527.3; 29/527.4; 29/530; 29/889.7; 29/889.71; 29/889.2

(58) Field of Classification Search
USPC ..... 29/419.1, 458, 525.14, 527.1, 527.4, 29/889.2, 889.7, 889.71, 530; 428/34.4, 34.5, 428/293.1, 539.5
See application file for complete search history.

(56) References Cited

U.S. PATENT DOCUMENTS 5,562,245 A * 10/1996 Berthelemy et al. ..... 228/190
5,946,801 A * 9/1999 Twigg et al. ..... 29/889.71

(Continued)

FOREIGN PATENT DOCUMENTS

| | | |
|---|---|---|
| EP | 0 831 154 | 3/1998 |
| EP | 1 099 774 | 5/2001 |
| EP | 1 726 676 | 11/2006 |
| EP | 1 726 677 | 11/2006 |

OTHER PUBLICATIONS

U.S. Appl. No. 12/810,949, filed Jun. 28, 2010, Masson, et al.

(Continued)

*Primary Examiner* — Peter DungBa Vo
*Assistant Examiner* — Anthony Green
(74) *Attorney, Agent, or Firm* — Oblon, Spivak, McClelland, Maier & Neustadt, L.L.P.

(57) ABSTRACT

A process for manufacturing a metal part reinforced with ceramic fibers, in which: a housing is formed for an insert in a main metal body having an upper face; an insert formed from a bundle of fibers with a metal matrix is placed in the housing; a metal cover is placed on the main body so as to cover the insert; the cover is welded onto the metal body; a hot isostatic pressing operation is carried out; and the part obtained is machined to the desired shape. The housing has the shape of a notch of L-shaped cross section with a face perpendicular to the upper face and a face parallel to the upper face, the cover having an internal notch of L-shaped cross section, this having a shape complementary to that of the metal body with said insert, the cover being shaped on the outside so that the pressure forces are exerted perpendicular to said faces of the notch.

10 Claims, 4 Drawing Sheets

U.S. PATENT DOCUMENTS

| | | | | |
|---|---|---|---|---|
| 6,658,715 | B1 * | 12/2003 | Podesta' | 29/419.1 |
| 2005/0166386 | A1 * | 8/2005 | Twigg | 29/458 |
| 2006/0254744 | A1 * | 11/2006 | Gordon et al. | 164/98 |
| 2006/0269746 | A1 | 11/2006 | Franchet et al. | |
| 2007/0051455 | A1 * | 3/2007 | Franchet et al. | 156/169 |
| 2009/0200887 | A1 * | 8/2009 | Okamoto et al. | 310/195 |

OTHER PUBLICATIONS

U.S. Appl. No. 12/810,874, filed Jun. 28, 2010, Masson.

* cited by examiner

PROCESS FOR MANUFACTURING A METAL PART REINFORCED WITH CERAMIC FIBRES

The present invention relates to the manufacture of metal parts having internal reinforcements formed from ceramic fibers, and comprising the incorporation of an insert made of a composite of the type consisting of ceramic fibers in a metal matrix.

For the purpose of reducing the weight of metal parts while giving them greater strength, especially in tension or in compression, it is known to incorporate ceramic fibers thereinto. For example, these are silicon carbide (SiC) fibers which have a tensile strength and a compressive strength that are substantially greater than that of a metal such as titanium.

The manufacture of these parts involves the prior formation of inserts from ceramic filaments with a metal matrix, which inserts comprise a ceramic fiber coated with metal. They are also referred to as CMM fibers or coated filaments. The metal gives the elasticity and flexibility necessary for handling them.

A known process for manufacturing such reinforced parts comprises the production of a winding of a coated filament around a mandrel. The winding is then introduced into a main metal body or container in which a slot forming a housing has been machined beforehand.

The depth of the slot is greater than the height of the winding. A cover is placed on the container and welded to its periphery after applying a vacuum. The cover has a tenon having a shape complementary to that of the slot, and its height is adapted to that of the winding placed in the slot so as to fill the slot. Next, a hot isostatic pressing step is carried out, during which the cover is deformed and the winding is compressed by the tenon.

The hot isostatic pressing technique consists in placing the part in an enclosure subjected to high pressure, of the order of 1000 bar, and also to high temperature, of the order of 1000° C., for a few hours.

The metal sheaths of the coated filaments are welded together and to the walls of the slot by diffusion, to form a dense assembly composed of a metal alloy within which the ceramic fibers extend. The part obtained is then machined to the desired shape.

The process serves for the manufacture of axisymmetric aeronautical parts, such as rotor disks, blinks (integrally bladed disks), shafts, actuator bodies, casings, etc. Oblong parts are also produced, for example to form connecting rods.

It is difficult to machine the slot in the main body, especially because of the small radii in the bottom of the slot. This small radius is necessary in order to house the insert, which has a rectangular cross section. The machining of the corresponding tenon in the cover is not easy either, because of the non-open-ended corners. In particular when the parts to be machined are not axisymmetric, but are long, with an oval shape or with straight portions, precise adjustment over long lengths is difficult to achieve. This is even more difficult for inserts formed from very rigid coated filaments because of the ceramic fibers that require the formation of housings in which they fit perfectly.

Instead of manufacturing the insert separately and then transferring it to the slot of the main body, patent FR 2 886 290 in the name of SNECMA proposes, according to one embodiment, to produce the winding directly on the main body. Instead of a slot, two shoulders are provided in the body. The first one has a bearing surface for the direct winding of a coated filament. This surface is parallel to the winding direction. When the winding has been completed, the slot is reconstituted by placing a part on the main body which has a shape complementary to that of a second shoulder forming a step in relation to the first shoulder. The cover with the tenon is then positioned on the insert that has just been wound and the assembly undergoes a compacting operation. The manufacturing problem is only partly solved by this solution, since the assembly operation remains complicated.

The Applicant was set the objective of improving the process for manufacturing such parts for the purpose of simplifying the steps of the production operation and of reducing the costs.

In accordance with the invention, the process for manufacturing a metal part reinforced with ceramic fibers, in which:

- a housing for an insert is formed in a metal body having an upper face;
- at least one insert formed from fibers with a metal matrix is positioned in the housing;
- a metal cover is placed on the body so as to cover the insert;
- the cover is welded to the metal body after being placed under vacuum;
- the assembly is subjected to a hot isostatic pressing treatment;

and the treated assembly is machined to the desired shape, is characterized in that the housing has the shape of a notch of L-shaped cross section with two mutually perpendicular faces, the cover having an internal notch of L-shaped cross section and of shape complementary to that of the notch in the metal body with said insert, the cover being shaped on the outside so that the compressive forces are exerted perpendicular to said faces of the notch.

Preferably, the notch in the metal body comprises a face perpendicular to said upper face and a face parallel to said upper face.

Thus, by modifying the geometry of the parts to be assembled, compared with the prior art, there is better access for the tool used to machine the housing for the insert, both in the case of the main body and in the case of the cover, thereby making these operations less tricky to carry out and therefore less expensive. The number of parts is reduced to two, thereby simplifying the assembly operation compared with the previous solution. Moreover, this geometry makes it possible to apply the compressive forces in two nonparallel directions, contributing to more efficient compacting. It should be noted that, in the case of an annular insert, the deformation of the insert is parallel to its axis.

This solution allows for different embodiments. According to a first embodiment, the insert is formed beforehand by winding a coated filament and it is placed in the notch. According to another embodiment, the insert is formed by winding a coated filament directly in the notch, the latter forming a winding mandrel.

This solution also makes it possible to produce different parts. The insert may have an annular shape. It may thus form, depending on the geometry of the part to be reinforced, an axisymmetric ring, or else for parts of elongate shape it may have at least one straight portion. For parts of elongate shape, the insert may also need not be annular but may be formed from one or more straight elements.

More precisely, the cross section of the winding is rectangular, a first face of the winding bearing against one face of the notch and a second face of the winding bearing against the other face of the notch.

Advantageously, the cover has a centering surface portion that cooperates with one face of the notch, especially that face of the notch in the main body perpendicular to the upper face of the latter, in order to center and guide the deformation of the cover on the main body.

The invention will now be described in greater detail with reference to the appended drawings in which.

Figure 1:
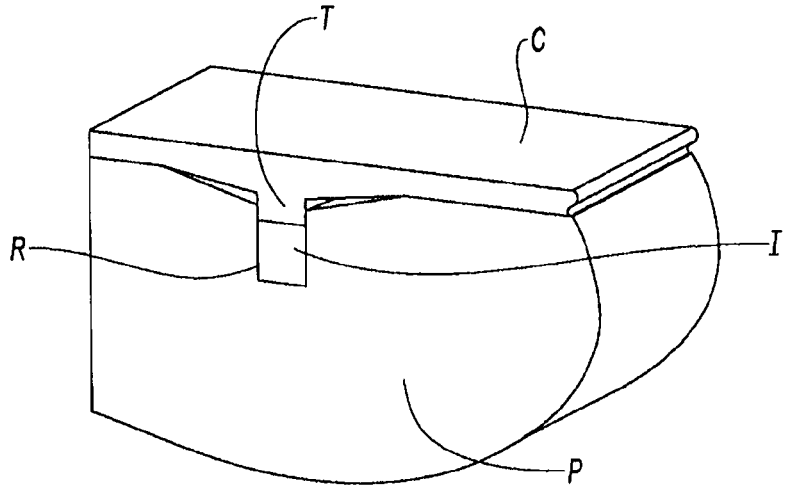
FIG. 1 shows a diagram of a part with an insert according to the prior art.

The diagram of FIG. 1 illustrates one operating method of the prior art. The main metal body P includes a slot R of rectangular cross section. The insert I consisting of a bundle of coated filaments, held temporarily and tied together, is placed in this slot. A second part forming the cover C is placed on the main body P, this second part having a tenon T with a shape matched to the slot R and bearing on the insert I. The edges of the slot R or of the tenon T are beveled so as to provide a clearance with that part of the cover adjacent to the tenon. During the hot isostatic pressing operation, the pressure is exerted in the direction perpendicular to the surface of the cover. The pressure and heat serve to make the metal of the matrix occupy the spaces between the coated filaments constituting the insert. The volume of the insert decreases by 23%. The tenon is thus moved downward and the clearance on either side of the tenon is absorbed. After the process, the metal has fused and the part is thus reinforced by the filaments embedded in the mass of metal. A similar technique is described in the patent EP 831 154.

Figure 2:
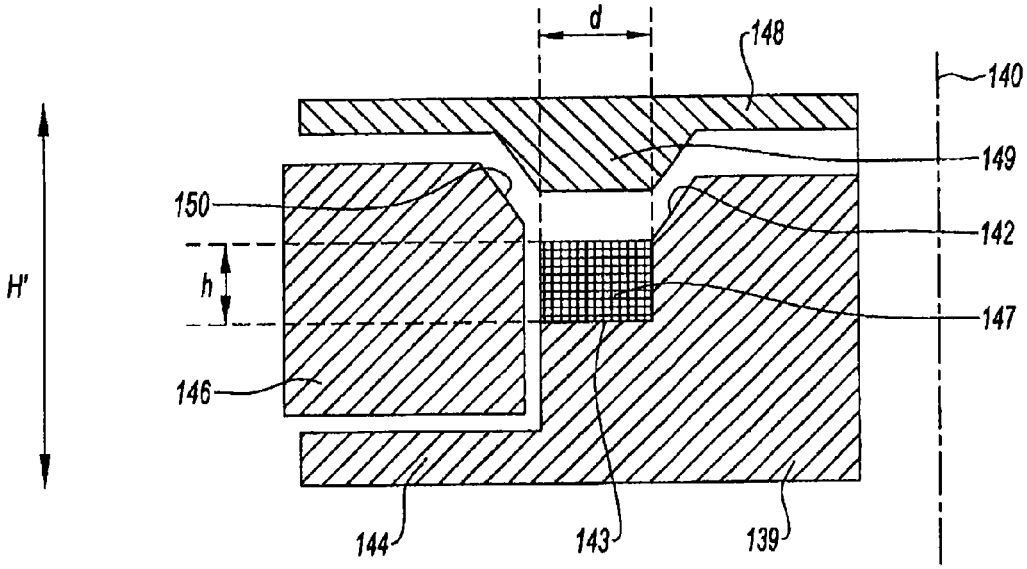
Fig. 2 Prior Art
FIG. 2 shows the solution of the prior art as presented in the patent FR 2 886 290 with two shoulders.

As may be seen in FIG. 2, taken from the patent FR 2 886 290, a main body 139 of revolution about the axis 140, made of a titanium alloy for example, comprises an internal portion central with respect to the axis and having a height H' equal to the height of the container. Its periphery 142 is beveled as far as a first shoulder 143 of height h and width d. On the periphery of this shoulder is a second shoulder 144, the radial dimension of which completes the width of the container. Its surface 145 extends up to a height below that of the surface of the first annular shoulder. An annular insert 147 formed from a bundle of coated filaments temporarily held together is put into position. An outer ring 146 is added to the second shoulder, having a height corresponding to that of the central portion of the main body. The outer ring 147 is welded so as to reconstitute a slot with the first shoulder. The cover 148 has an annular projection 149 and bears on the bundle of coated filaments. From this phase onward, the process is the same as the previous process.

A nonlimiting method of implementing the solution of the invention is shown in the following figures.

Figure 3:
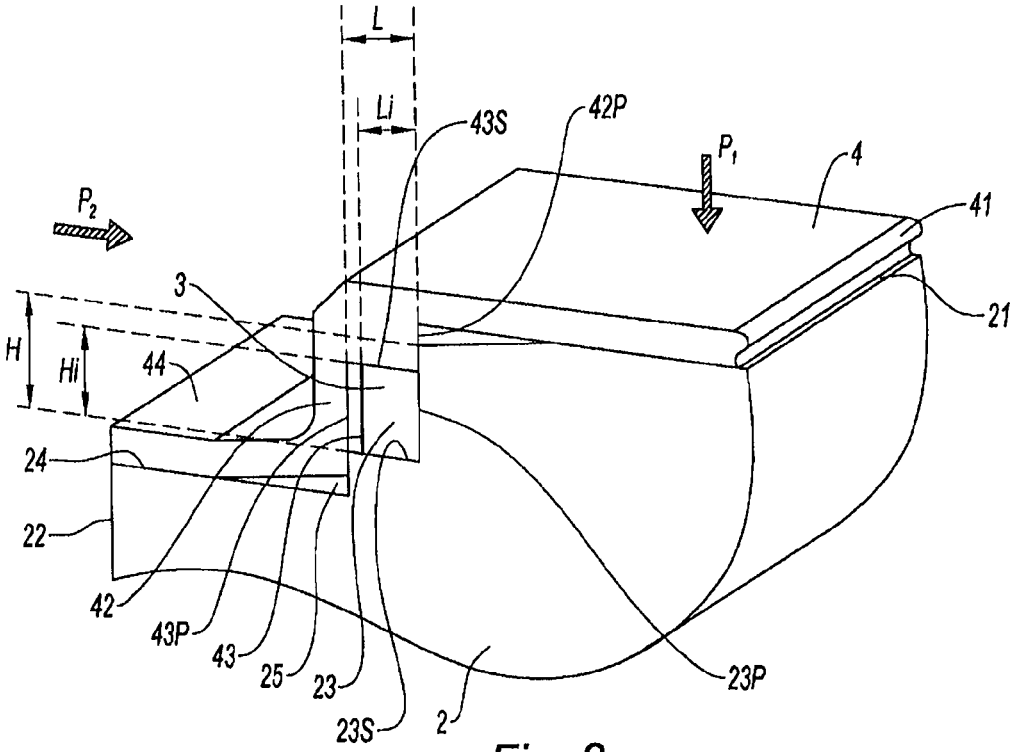
FIG. 3 shows the solution of the invention with a notch both in the main body and in the cover.

FIG. 3 shows, in cross section and in perspective, a portion of a part to be manufactured, incorporating an insert. The main body 2 of the metal part, for example made of a titanium alloy, has an upper face 21 and a peripheral edge 22. A notch 23 of L-shaped cross section, set back from the edge 22, has been machined. This notch has a face 23P, perpendicular to the upper face 21, and a face 23S parallel to the latter. The height H of 23P and the width L of 23S are determined according to the dimensions of the insert to be placed. Between the notch 23 and the edge 22, the main body 2 has an edge surface portion 24 with a height smaller than that of the surface 23S, while a shoulder 25 forms the transition between the two portions 23 and 22.

An insert 3 formed from a bundle of coated filaments and having a rectangular cross section is housed in the notch. Its height Hi is slightly smaller than that of the face 23P and its width Li is also smaller than that of the face 23S.

Advantageously, but not limitingly, the insert may be produced using one of the methods taught by the patent FR 2 886 290. This comprises the structure of the coated filaments, the manufacture of said filaments, the manufacture of a bonded ply of coated filaments, the bonding of this ply either to the metal support on which it is wound or to the ply of the lower layer, and the welding of the filaments by laser or by contact between two electrodes.

When the insert is a straight insert, it is advantageously already compacted and manufactured according to the technique described in the patent application filed by the Applicant under the number FR 07/05454 on Jul. 26, 2007.

Placed on the main body 2 is a cover 4 shaped so as to match the various portions of the main body with the insert. More precisely, it comprises a bottom wall 41 that bears on the upper face 21, an edge wall 44 that bears on the edge surface portion 24 and a perpendicular side wall 42 between the two walls 41 and 44. This side wall has an internal notch 43. The notch has an L-shaped cross section with a face 43P perpendicular to the bottom wall 41. This face extends alongside the shoulder 25 which it overlaps. The notch has a face 43S parallel to the face 23S of the notch 23 in the main body 2 and bears against the upper face of the insert 3. The width of the face 43S is the same as that of the face 23S. Since the height Hi of the insert is slightly smaller than the height H of the face 23P, the wall 42 is in contact with the latter via its surface portion 42P.

The cover does not match the main body 2 at three places. A bevel is machined between the upper face 21 of the main body and the notch 23 providing a clearance with the bottom wall 41. This clearance may also be obtained by hollowing out the bottom wall. Likewise, a clearance is provided between the edge wall 44 and the edge surface 24. It should also be noted that since the width Li of the insert is slightly smaller than that of the face 23S of the notch 23, a space is created between the face 43P of the notch 43 of the cover and the insert.

When the cover and the main body are thus placed together, welded and under vacuum, the assembly undergoes a hot isostatic pressing treatment, the pressure exerted on the assembly producing forces along two directions P1 and P2. The compressive force along the direction P1 is exerted on the external face of the cover, of the bottom wall 41 and of the edge wall 44 that are parallel. The pressure is also exerted along the direction P2 perpendicular to P1 on the external face of the side wall 42 which is perpendicular to the first two external faces.

The forces on the cover along the direction P1 cause it to deform parallel to the faces 23P and 43P with the insert being compacted in this direction and the clearance, between the bottom wall 41 and edge wall 44 of the cover 4 and the upper face 21 and edge face 24 of the main body 2, being absorbed.

The clearance between the face 43P of the notch in the cover and the insert is also absorbed by the deformation of the cover resulting from the compressive forces along the direction P2.

If the insert is of annular shape, it undergoes no deformation in the plane perpendicular to the axis of the ring.

Figure 4:
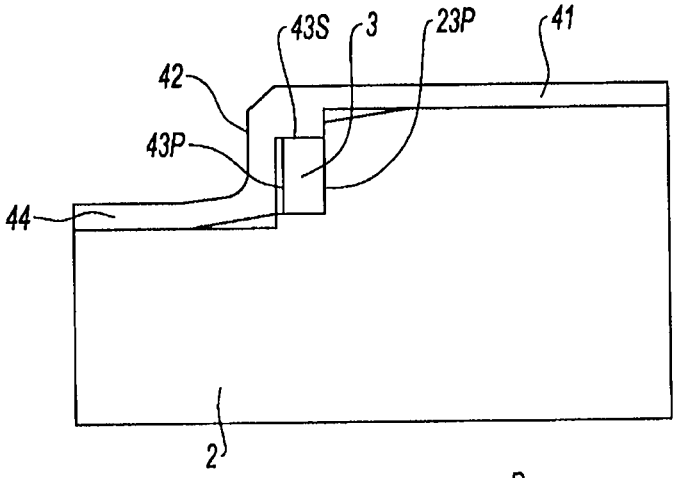
FIGS. 4 and 5 are a simulation of the deformation of the cover and the insert during the hot isostatic pressing operation.
Figure 5:
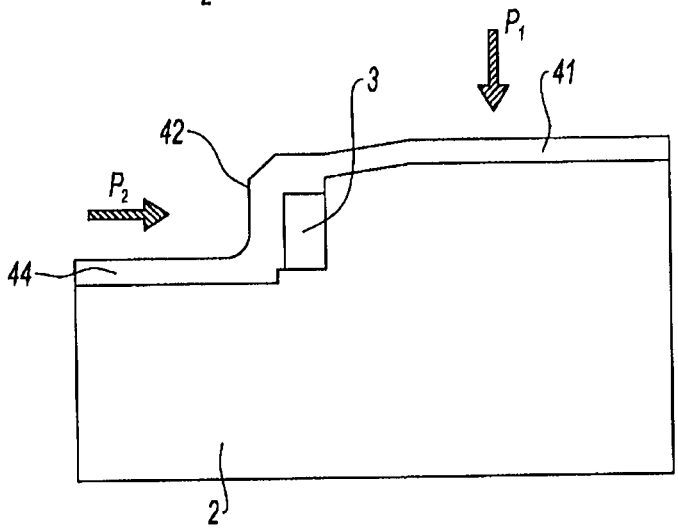

FIGS. 4 and 5 show a simulation of the deformations undergone by the cover and the insert. The insert is of axisymmetric shape and the deformations are oriented in the direction of the axis of the insert.

Because of the simple shapes involved, the process of the invention has the advantage of being able to produce the notch in the main body using a conventional milling tool. The same applies to the notch in the cover.

Figure 6:
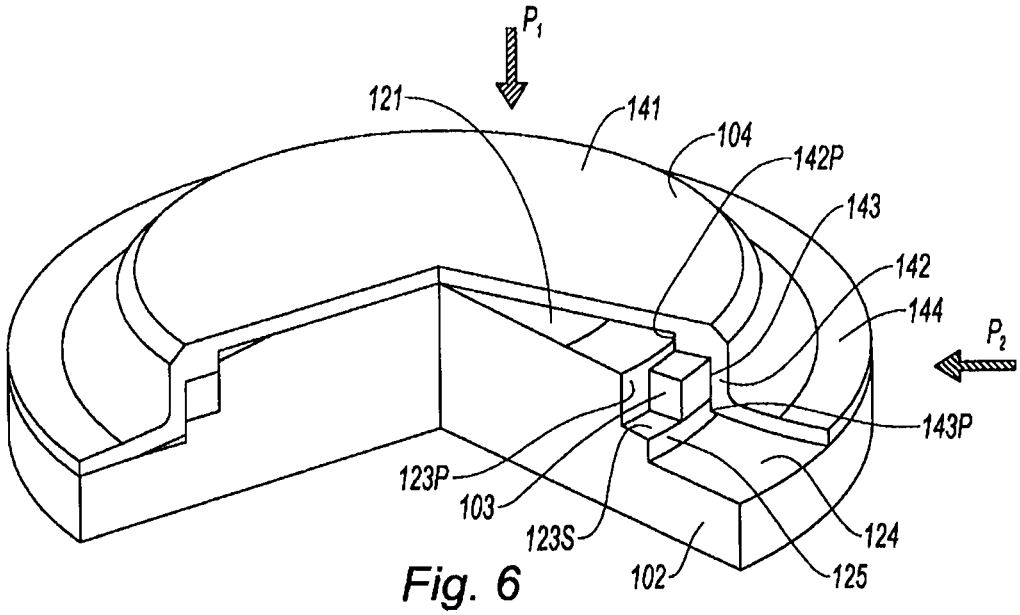
FIG. 6 shows the application of the invention to the production of an axisymmetric part.

The notch may be axisymmetric in order to produce an axisymmetric part. FIG. 6 shows in perspective, with a portion cut away, a main body 102 assembled with a cover 104.

The main body 102 has a notch 123 which is axisymmetric about the axis thereof, for housing an insert 103 which is of annular shape. The assembly is covered by a cover 104 with a notch 143. The same elements as in FIG. 3 are found, but with the references increased by 100. The insert is retained between the notch 123 in the body 102 and the notch 143 in the cover 104, the isostatic pressing having the effect of compressing the insert 103 along the direction P1. The faces 142P and 143P of the notch 143 slide along the faces 123P and 125 of the body 102, compressing the insert 103. Secondary compression is provided by the forces along the direction P2, which deform the wall 142.

The insert may be produced by winding it separately and then fitting it into the notch. However, the shape allows it to be wound directly in the notch.

Figure 7:
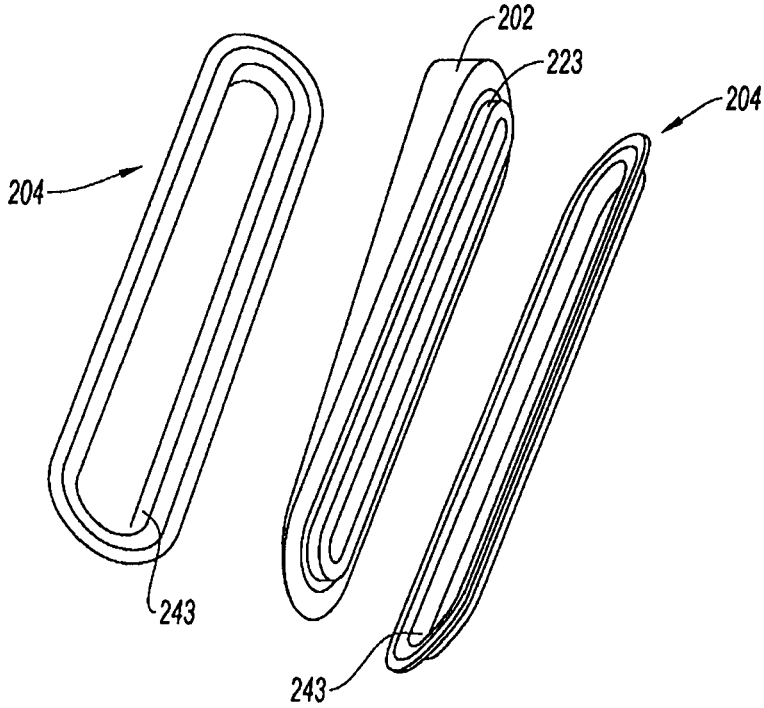
FIG. 7 shows the application of the invention to the production of a part of elongate shape.
Figure 7:
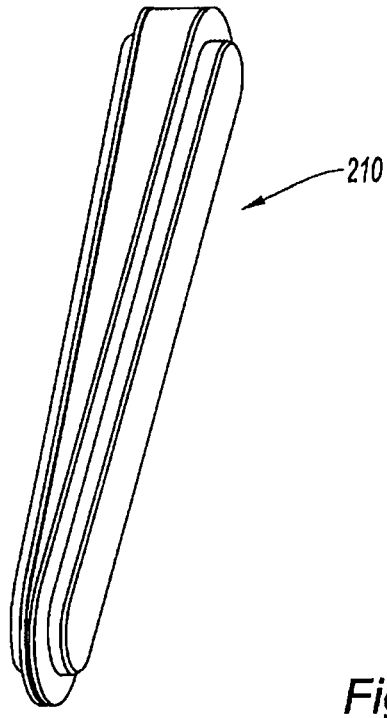

The invention allows the production of parts that are not axisymmetric, such as those shown in FIG. 7. The references point to the same portions as in FIG. 3 but are increased by 200 therefrom. The main body 202 has an elongate shape, which is split into two semicircular portions joined together by two straight portions. The notch 223 is of elongate shape with two semicircular portions and two straight portions. This notch receives an insert of corresponding shape. The part comprises two faces with two notches 223 that are covered by two covers 204, each having a notch 243.

The assembled part ready for the hot isostatic pressing treatment is shown at 210.

Figure 8:
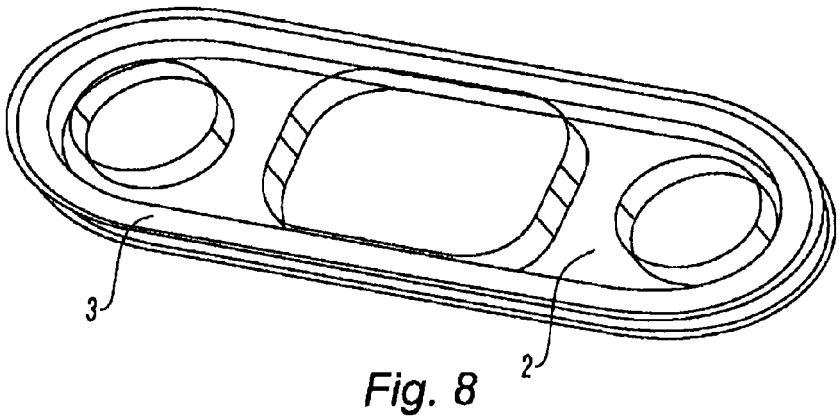
FIG. 8 shows an example of a finished part produced in accordance with the invention, after machining.

FIG. 8 shows an example of a part that can be produced using the process. The insert 3 is embedded in the mass of the body 2—it is shown in the figure as if the body were transparent. The part was machined in order to give it the desired shape. Using this technique, it is thus possible to produce elongate parts such as connecting rods in an aircraft landing gear, working both in tension and in compression.

More generally, a notch which is not necessarily annular may be easily provided in a main body, for example a notch with straight portions. The machining of corresponding notches is also easy.

The invention claimed is:

1. A process for manufacturing a metal part reinforced with ceramic fibers, comprising:

a housing for an insert is formed in a main metal body having an upper face;

an insert formed from fibers with a metal matrix is positioned in the housing;

a metal cover is placed on the main metal body so as to cover the insert;

the metal cover is welded to the main metal body under vacuum;

an assembly is subjected to a hot isostatic pressing treatment; and the treated assembly is machined to a desired shape, wherein the housing has the shape of a notch of L-shaped cross section with two mutually perpendicular faces, the cover having an internal notch of L-shaped cross section and of shape complementary to that of the notch in the metal body with said insert, and the cover being shaped on the outside so that compressive forces are exerted perpendicular to said faces of the notch.

2. The process as claimed in claim 1, wherein the notch in the metal body comprises a face perpendicular to the upper face of the main metal body and a face parallel to the upper face of said body.

3. The process as claimed in claim 1 or 2, wherein the insert is a winding formed beforehand by winding a coated filament and it is placed in the notch of the main metal body.

4. The process as claimed in claim 1 or 2, wherein the insert is formed by winding a coated filament directly in the notch of the main metal body, said notch forming a winding mandrel.

5. The process as claimed in claim 3, wherein the insert has an annular shape.

6. The process as claimed in claim 5, wherein the insert forms an axisymmetric ring.

7. The process as claimed in claim 6, wherein the axisymmetric ring formed by the insert has at least one straight portion.

8. The process as claimed in claim 3, wherein the cross section of the winding is rectangular, a first face of the winding bearing against one face of the notch of the main metal body and a second face of the winding bearing against the other face of the notch.

9. The process as claimed in claim 1, wherein the cover has a centering surface portion that cooperates with one face of the notch of the main metal body in order to center and guide a deformation of the cover on the main metal body.

10. The process as claimed in claim 9, wherein the face is perpendicular to the upper face of the main metal body, the centering surface portion of which cooperates with said face of the notch perpendicular to the upper face of said notch.

* * * * *